US010820127B2

(12) United States Patent
Meier et al.

(10) Patent No.: US 10,820,127 B2
(45) Date of Patent: Oct. 27, 2020

(54) DOME FOR USE WITH A RECEIVER ASSEMBLY , ASSEMBLY , RCEIVE MODULE, HEARING DEVICE AND A METHOD OF CONNECTING A DOME

(71) Applicant: Sonova AG, Staefa (CH)

(72) Inventors: Georg Hans Meier, Uerikon (CH); Andre Ochsenbein, Wolfhausen (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/482,265

(22) PCT Filed: Feb. 2, 2017

(86) PCT No.: PCT/EP2017/052211

§ 371 (c)(1),
(2) Date: Jul. 31, 2019

(87) PCT Pub. No.: WO2018/141386

PCT Pub. Date: Aug. 9, 2018

(65) Prior Publication Data

US 2019/0349696 A1 Nov. 14, 2019

(51) Int. Cl.
*H04R 25/00* (2006.01)

(52) U.S. Cl.
CPC ..... *H04R 25/656* (2013.01); *H04R 25/48* (2013.01); *H04R 25/658* (2013.01)

(58) Field of Classification Search
CPC ..... H04R 25/48; H04R 25/65; H04R 25/652; H04R 25/656; H04R 25/658
See application file for complete search history.

(56) References Cited

U.S. PATENT DOCUMENTS

| | | | | |
|---|---|---|---|---|
| 5,002,151 A * | 3/1991 | Oliveira | A61F 11/08 181/130 |
| 5,730,409 A | 3/1998 | Baron et al. | |
| 9,287,657 B2 * | 3/2016 | Hankey | B21C 23/18 |
| 2008/0298618 A1 * | 12/2008 | Baumann | H04R 25/656 381/325 |

FOREIGN PATENT DOCUMENTS

| | | |
|---|---|---|
| DE | 19908854 | 9/2000 |
| DE | 102008052681 B3 | 6/2008 |
| DE | 102007009738 A1 | 9/2008 |
| DE | 102010007610 A1 | 8/2011 |
| DE | 102010022324 A1 | 12/2011 |
| DE | 102012201216 A1 | 8/2013 |
| DE | 102012211583 A1 | 8/2013 |
| DE | 102014200605 A1 | 4/2015 |
| WO | 2009150258 | 12/2009 |

OTHER PUBLICATIONS

European Patent Office, International Searching Authority, International Search Report for PCT/EP2017/052211, dated Aug. 9, 2018, Rijswijk, Netherlands.

* cited by examiner

*Primary Examiner* — Brian Ensey

(57) ABSTRACT

The present invention relates to a dome (10) for use with a receiver assembly (20). The dome (10) comprises a core (12) and a shell (14), wherein the core (12) and the shell (14) are made of different materials, the material of the core (12) is rigid and the material of the shell (14) is soft, and wherein the dome (10) is connectable to the receiver assembly (20) by means of a threaded connection (34). Therefore, connecting and separating the dome (10) to and from the receiver assembly (20) can be simplified in a secure and easy operation performed by the user.

13 Claims, 4 Drawing Sheets

DOME FOR USE WITH A RECEIVER ASSEMBLY , ASSEMBLY , RCEIVE MODULE, HEARING DEVICE AND A METHOD OF CONNECTING A DOME

TECHNICAL FIELD

The present invention is related to a dome for use with a receiver assembly, a receiver assembly, a receiver module, a hearing device and a method of connecting a dome.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

Commonly known hearing devices can comprise a base module and a receiver assembly connected to the base module.

Further, a dome can be comprised which can be plugged onto a sound outlet port (also referenced as speaker output or rather spout) of the receiver assembly such to provide acoustic sealing within the ear canal in order to prevent that sound, which is output from the receiver assembly, is transmitted to the microphone of the hearing device. Further, the dome can be adapted to proper fit at least one component of the hearing device to the ear canal of the user, for example the receiver assembly, a sound tube, etc.

Different domes are available which can vary in outer shape, size, material, elasticity, etc. The domes available in the market can be plugged or rather clipped onto the sound outlet port (spout). Document DE 10 2010 007 610 A1 shows a connection assembly allowing the dome to be mounted to the receiver. In order to separate the dome from the receiver, the user must apply a respective force such to exceed a predetermined clamping force. This requires force and further demands skill from the user in order to prevent that at least some of the hearing device components will be damaged.

Document U.S. Pat. No. 6,129,174 discloses a dome which is made of a soft material, wherein the dome is mounted to at least a part of the receiver assembly by means of screwing.

It is a problem in the state of the art that at least some of components of the hearing device, the dome itself or the hearing device as a whole can be damaged while separating the dome from at least one hearing device component, for example in the course of maintenance, exchange of the dome, etc. In an example, the dome needs to be replaced when the dome itself is defect or exhausted, for example soiled or ineligible. While separating the dome from the hearing device component, e.g. from the receiver assembly, many users tend to apply a pulling force while holding a sensitive component of the receiver assembly, for example a cable thereof. However, this manipulation often results in cable breakage which can result in a complete failure of the hearing device. Damages to the hearing device incurred due to irregular manipulation by the user in the attempt to remove the dome can result in long down times of the hearing device and might further incur high costs due to maintenance.

It is therefore an object of the present invention to provide a dome for use with a receiver assembly, a receiver assembly, a receiver module, a hearing device and a method of connecting a dome solving problems in the state of the art.

SUMMARY OF THE INVENTION

The present invention is directed to a dome for use with a receiver assembly, said dome comprising a core and a shell, wherein the core and the shell are made of different materials, the material of the core is rigid and the material of the shell is soft, and wherein the dome is connectable to the receiver assembly by means of a threaded connection.

Hence, provided is a dome for use with a receiver assembly, wherein the dome is connected to the receiver assembly by means of screwing. Therefore, problems in the state of the art which might occur due to irregular manipulation of the user in the attempt to separate the dome from the receiver assembly can be avoided. This problem is solved by means of the threaded connection, wherein the material of the core is rigid while the material of the shell is soft. The provision of the core which is made of rigid material provides the possibility to easily and securely screw thereof on e.g. a male thread of the receiver assembly. In this example, the rigid core comprises a female thread. In other words, the core which is made of rigid material allows to be grasped by the user properly and firmly such to be able to be screwed onto the receiver assembly (threaded connection). On the other hand, the shell of the dome is made of a soft material allowing the shell to properly deform such to assume the shape of the ear canal once inserted. This provides a snuggle fit connection to the ear canal in order to allow e.g. proper acoustic sealing. Further, the shell made of the soft material obviates the user to be hurt.

In an embodiment of the proposed dome a front face of the core is formed with at least one indentation, and a front face of the receiver assembly is formed with at least one projection, wherein the at least one indentation and at least one projection are engageable to each other. In this embodiment, surfaces (front faces) of the core and the receiver assembly, respectively, facing each other once threadingly engaged, are provided with a tooth-like array formed with indentations and projections, respectively. This tooth-like array formed with indentations (core) and projections (receiver assembly) provides increased interlocking once the core and the receiver assembly are engaged. The tooth-like array can be provided in an annular shape. The projections and indentations can be arranged conversely, i.e. a front face of the core can be formed with at least one projection, and a front face of the receiver assembly can be formed with at least one indentation, wherein the at least one projection and at least one indentation are engageable to each other. This tooth-like array formed with projections (core) and indentations (receiver assembly) provides increased interlocking once the core and the receiver assembly are engaged, as well.

In an embodiment of the proposed dome the at least one indentation and at least one projection are engageable to each other once the core is completely screwed onto the receiver assembly. The indentations and projections provide interlocking due to mutual abutment once engaged. This engagement can be released only if the user applies an unscrew-torque to the core and the receiver assembly which torque needs to exceed a respective threshold in order to separate the core from the receiver assembly. Hence, unintentional separation between the core (and thus the dome) and the receiver assembly can be avoided.

In an embodiment of the proposed dome the indentations and projections are formed circumferentially on the front face of the core and receiver assembly, respectively. The indentations and projections can be formed in an annular array which can be provided to the front faces of the core and the receiver assembly, respectively.

In an embodiment of the proposed dome the threaded connection comprises a female thread formed into the core such to extend substantially along the longitudinal direction thereof, and wherein the female thread is threadingly connectable to a male thread protruding from the receiver assembly. Therefore, the dome by its core can be screwed by its female thread to the male thread which protrudes from the receiver assembly. This allows the user to connect the dome to the receiver assembly easily and without further instructions.

In an embodiment of the proposed dome the threaded connection comprises a male thread protruding from the core, and wherein the male thread is threadingly connectable to a female thread formed into the receiver assembly. Therefore, the dome by its core can be screwed by its male thread to the female thread which is formed to the receiver assembly. This allows the user to connect the dome to the receiver assembly easily and without further instructions.

In an embodiment of the proposed dome the core comprises a cerumen filter adapted to protect the receiver assembly against entrance of cerumen. In this embodiment, the cerumen filter and the core are formed integrally. Therefore, the cerumen filter can be replaced easily while replacing the dome as a whole. Therefore, in an example, time required for maintenance can be reduced.

In an embodiment of the proposed dome the cerumen filter is opened to a passage formed into the shell. Further, in an embodiment of the proposed dome the passage is opened to an ear canal of the user of the hearing device once inserted. Therefore, sound output from the receiver assembly can be transmitted via the cerumen filter and the passage to the inner ear canal. Entrance of cerumen to the receiver assembly can thus be blocked by the cerumen filter reliably.

In an embodiment of the proposed dome the core is mounted to the shell by means of a form fit connection. In this embodiment, while manufacturing of the dome, the core can be clamped easily into a recess or rather receptacle which is correspondingly formed into the shell. The resilient characteristic of the soft material of the shell can provide an improved connection due to clamping action. In another embodiment, the core and shell are glued together.

In an embodiment of the proposed dome the core and shell are manufactured by means of a 2-K manufacturing. The 2-K manufacturing allows to manufacture the dome in a one-step procedure. Therefore, for example, additional steps required in order to connect the core to the shell can be omitted resulting in reduced time of manufacturing. Therefore, manufacturing costs can be reduced.

In an embodiment of the proposed dome the shell is provided with a plurality of openings arranged circumferentially. In a further embodiment of the proposed dome the openings are formed such to allow for a snuggle fit connection of the shell inside the ear canal of the user and/or for venting. Said openings impart the shell with improved elasticity or rather deformation resulting in an improved snuggle fit connection to the inner ear canal once inserted. Further, once inserted, venting can be improved, too.

Moreover, the present invention is directed to a receiver assembly comprising a receiver and an enclosure for accommodating the receiver, the enclosure comprising means for threadingly receiving a dome according to one of claims 1 to 14. Therefore, a receiver assembly is provided comprising a receiver and a dome which can be connected by screwing, e.g. in a clockwise direction, and separated by unscrewing, e.g. in a counterclockwise direction.

In an embodiment, the receiver assembly comprises a front face formed with at least one projection engageable to at least one indentation formed on a front face of the core. Hence, front faces of the core and the receiver assembly, respectively, facing each other once threadingly engaged, are provided with a tooth-like array formed with indentations and projections, respectively. The tooth-like arrays formed with indentations on the front face of the core and with projections on the front face of the receiver assembly, respectively, provide increased interlocking once the core and the receiver assembly are engaged. The tooth-like array can be provided in an annular shape.

In an embodiment, the receiver assembly comprises a sound outlet port provided with a male thread adapted for threadingly receiving a female thread formed into a core comprised by the dome. Hence, provided is a receiver assembly which can be easily equipped with a dome by simply screwing the female thread formed into the core of the dome onto the male thread formed on or rather around the sound outlet port of the receiver assembly.

In an embodiment, the receiver assembly comprises a sound outlet port provided with a female thread adapted for threadingly receiving a male thread of a core comprised by the dome. Hence, provided is a receiver assembly which can be easily equipped with a dome by simply screwing the male thread of the core of the dome into the female thread formed to the sound outlet port of the receiver assembly.

Moreover, the present invention is directed to a receiver module comprising a dome according to one of claims 1 to 14, and a receiver assembly according to one of claims 15 to 18 threadingly connected to each other. Said receiver module allows to easily remove the dome from the receiver assembly with reduced risks of damaging any components of the receiver module or the receiver module as a whole, for example a cable breakage.

Moreover, the present invention is directed to a hearing device comprising a base module, a dome according to one of claims 1 to 14, and a receiver assembly according to one of claims 15 to 18 operatively connected to the base module and threadingly connected to the dome.

Moreover, the present invention is directed to a method of connecting a dome according to one of claims 2 to 14 to a receiver assembly according to one of claims 16 to 18, said method comprising the step of screwing the core of the dome to the receiver assembly, wherein an acoustic or haptic feedback signal indicates the engagement of the at least one projection with the at least one indentation.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 1:
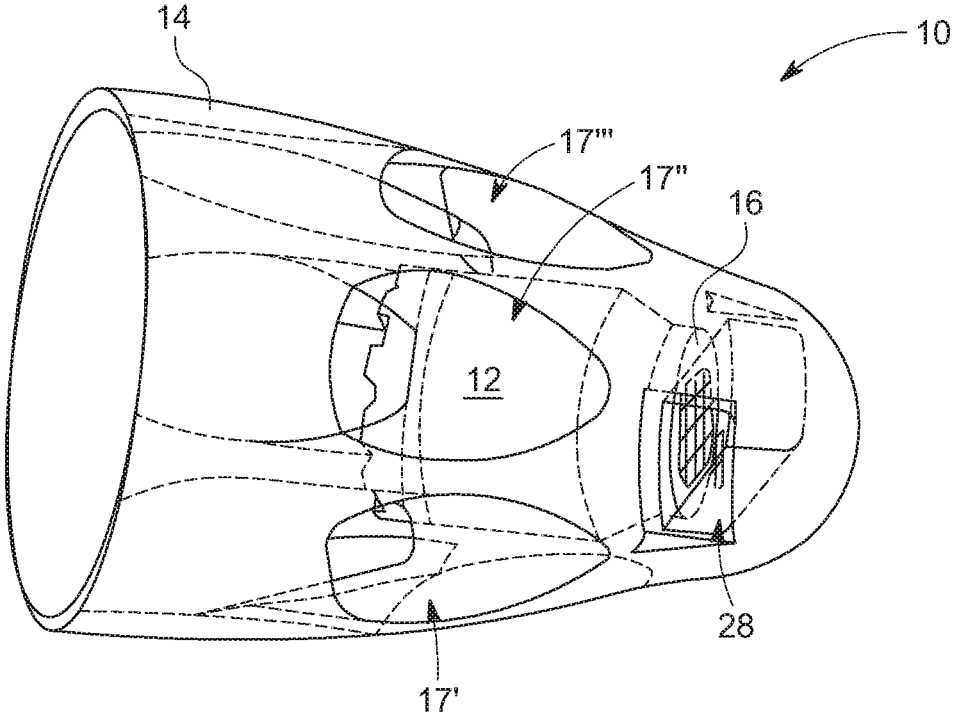
FIG. 1 shows a dome in a semi-transparent view according to an aspect of the invention.

FIG. 1 shows a dome 10 in a semi-transparent view according to an aspect of the invention. The dome 10 can be intended for use with a receiver assembly of a hearing device (both not shown). The dome 10 comprises a core 12 and a shell 14 which receives the core 12. The core 12 and shell 14 are made of different materials, wherein the material of the core 12 is rigid and the material of the shell 14 is soft. Advantages of said material selections involve that the user can reliably and firmly grasp the dome 10 by its rigid core 12, i.e. grasping the dome 10 at a portion substantially surrounding the core 12. In other words, the rigid core 12 provides a proper and firm support once grasped by the user.

On the other hand, the shell 14 is made of a soft material which imparts elasticity or rather deformability to the shell 14 such that the shell 14 easily assumes the shape of the ear canal once inserted. Therefore, acoustic sealing is improved. Further, due to the soft material of the shell 14, the dome 10 does not hurt the user while the dome 10 is inserted into the ear canal as well as the dome 10 is positioned in place in the ear canal. The material of the shell 14 can comprise silicon. The threaded connection comprised by the dome 10 allows the user to proper and easily connect the dome 10 by its rigid core 12 to the receiver assembly simply by screwing. Otherwise, separating the dome 10 from the receiver assembly can be easily performed by simply unscrewing the dome 10.

The core 12 can comprise a cerumen filter 16 for protecting the receiver assembly against e.g. entrance of cerumen. The cerumen filter 16 and the core 12 can be formed integrally which allows replacement of the cerumen filter 16 by simply replacing the dome 10.

The core 12 can be mounted to the shell 14 by means of a form fit connection. Additionally or as an option, the core 12 and shell 14 can be connected to each other by means of an adhesive (not shown). While not shown, the core 12 can be formed tapered in order to allow a proper and save insertion thereof by simply pushing the core 12 into a correspondingly formed receptacle provided into the shell 14. In an example, the core 12 and shell 14 are manufactured by means of a 2-K manufacturing. Therefore, manufacturing costs can be reduced.

The shell 14 can be provided with a plurality of openings 17'-17''' in order to allow for a snuggle fit connection of the shell 14 inside the ear canal of the user. This snuggle fit connection can be improved due to the openings 17'-17''' which can impart improved elasticity to the shell 14. Further, said openings 17'-17''' can provide improved venting. Therefore, the wear comfort of the dome 10 can be improved as a whole.

Figure 2:
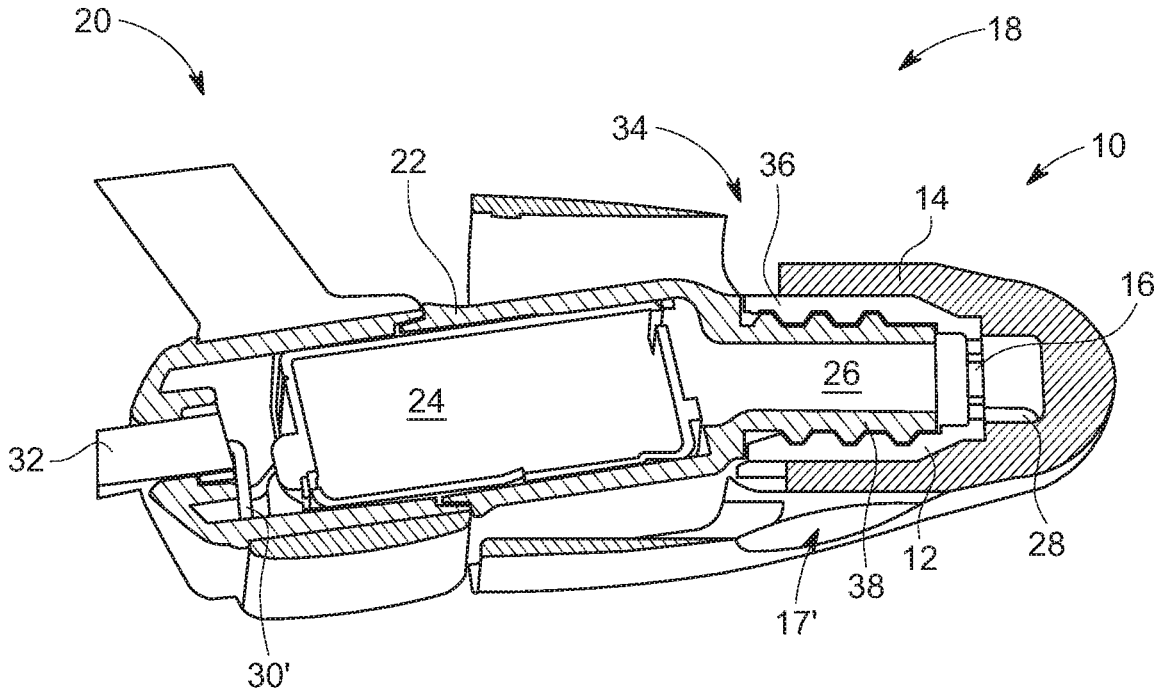
FIG. 2 shows a receiver module comprising a receiver assembly and a dome connected to each other in a cross sectional view according to an aspect of the invention.
Figure 3:
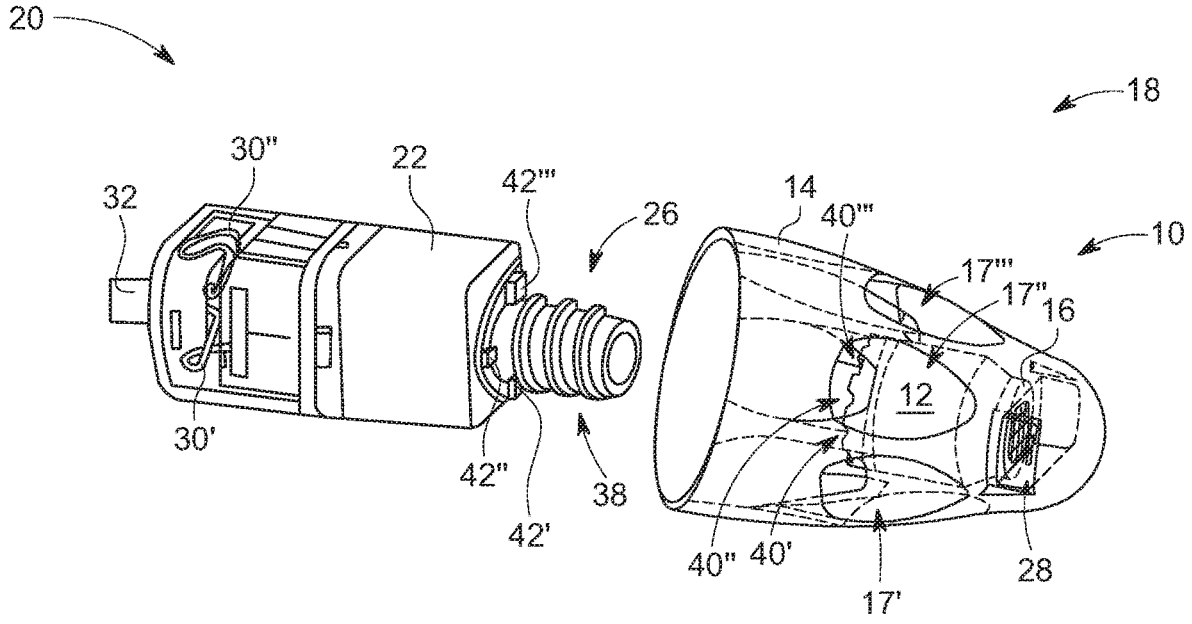
FIG. 3 shows a receiver module comprising a receiver assembly and a dome separated from each other in a perspective view according to an aspect of the invention.

FIG. 2 shows a receiver module 18 in a cross sectional view along a longitudinal direction. The receiver module 18 comprises the receiver assembly 20 and the dome 10 connected to each other. FIG. 3 shows the receiver module 18 as shown in FIG. 2 in a perspective view, wherein the receiver assembly 20 and the dome 10 are separated from each other. As mentioned above, the connection is a threaded connection as will be described in further detail in the following. The receiver assembly 20 comprises an enclosure 22 for accommodating a receiver 24. The sound output of the receiver 24 is opened to a sound outlet port 26, also referred as a spout. The sound reproduced by the receiver 24 is output to the ear canal via the sound outlet port 26, the cerumen filter 16 and a later described passage 28 which is formed into the shell 14. Said passage 28 is opened to the ear canal of the user once inserted. The receiver 24 is adapted to transduce electrical signals processed by a hearing device component of the hearing device or the hearing device itself (both not shown) into acoustic sound to be output to the sound outlet port 26. Said electrical signals are input to the receiver 24 via cables 30',30" (refer to FIG. 3) which can be guided into a cable guide 32. The shell 14 is formed such to substantially cover the sound outlet port 26 as well as portions or rather parts of the enclosure 22 of the receiver assembly 20 once the dome 10 and the receiver assembly 20 are connected to each other.

As mentioned above, the dome 10 can be mounted to the receiver assembly 20 by means of a threaded connection 34. Said threaded connection 34 comprises a female thread 36 which is formed into the core 12 such to extend substantially along the longitudinal direction thereof. The threaded connection 34 further comprises a male thread 38 which is formed along at least a portion of the sound outlet port 26. The female thread 36 and male thread 38 are formed such to threadingly engage each other. Therefore, connecting and separating the dome 10 to and from the receiver assembly 20 can be simplified in a secure and easy operation performed by the user. Hence, no further instructions to the user are required.

As mentioned above, FIG. 3 is a perspective view of the receiver module 18 showing the receiver assembly 20 and the dome 10 separated from each other in an aspect of the invention. As can be best seen in said figure, the front face of the core 12, e.g. at its rim, is provided with a plurality of indentations 40'-40''' formed circumferentially, e.g. equidistantly, to each other. In other words, the front face of the core 12 can be formed tooth-like. On the other hand, the front face of the receiver assembly 20 is provided with projections 42'-42''', wherein said projections 42'-42''' can be arranged circumferentially, e.g. equidistantly, to each other, as well. The indentations 40'-40''' as well as the projections 42'-42''' are arranged such to substantially face or rather overlie each other once the dome 10 is mounted to the receiver assembly 20.

Figure 4:
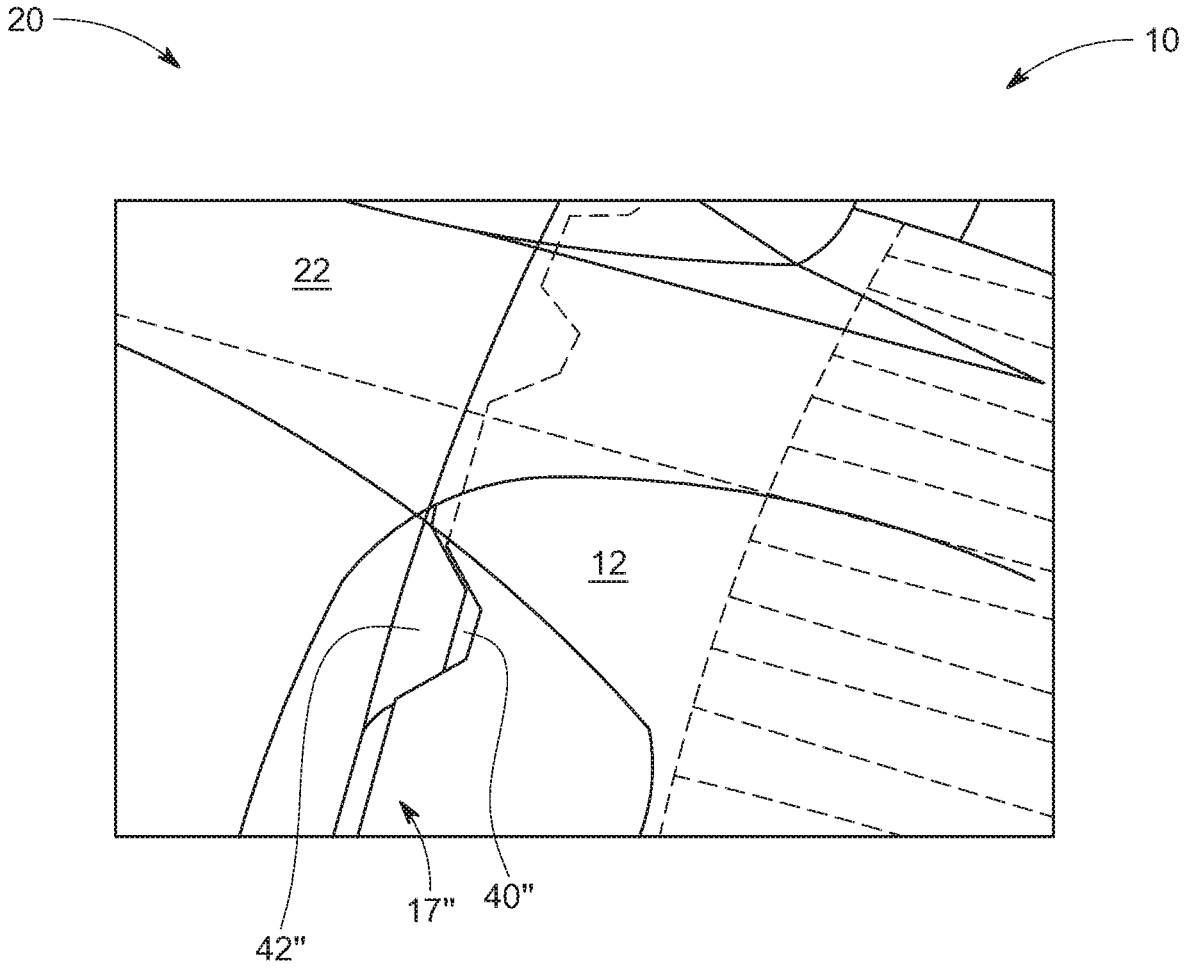
FIG. 4 shows the receiver module in an enlarged view in a portion of the receiver module in which the dome and the receiver assembly are engaged to each other.

FIG. 4 is an enlarged, semitransparent perspective view showing the receiver assembly 20 and dome 10 connected to each other in the aspect as shown in FIG. 3. In other words, FIG. 4 shows the core 12 of the dome 10 completely screwed onto the sound outlet port 26 of the receiver assembly 20. In this state, the indentations 40'-40''' of the core 12 and the projections 42'-42''' of the receiver assembly 20 are engaged to each other (refer to FIG. 3).

In this context, the term "engaged to each other" can comprise that one of projections of the receiver assembly 20 (e.g. projection 42") is received into one of indentations of the core 12 (e.g. indentation 40"). Referring back to FIG. 3 and having regard to FIG. 4, the projections 42'-42''' and indentations 40'-40''' are engageable to each other by allowing at least one of projections (e.g. 42") to snap into at least one of indentations (e.g. 40"). As shown in FIG. 4, at least one of flanks or rather least one of front walls of the projections 42'-42''' and/or indentations 40'-40''' can be tapered in order to allow improved reception and/or release. It is to be noted that the width of the indentations 40'-40''' is at least the minimum width of the projections 42'-42''' in order to allow reception of the projection into the indentation. This "snap into" state or rather connection or rather reception can be achieved by applying a respective increased torque to the receiver assembly 20 and the dome 10, respectively, once the projections 42'-42''' of the receiver assembly 20 and the indentations 40'-40''' of the core 12 substantially overlie or rather "first" abut to each other. The number of indentations and their width are a matter of design. In order to provide a more detailed illustration, FIG. 4 only shows projection 42'' snapped into indentation 40''.

Advantageously, in the engaged condition as depicted in FIG. 4, the receiver assembly 20 and the dome 10 are prevented from being separated from each other unintentionally. In a further advantage, the user can easily take notice of proper engagement just by hearing and/or feeling an audible and/or haptic feedback signal created by the projections 42'-42''' snapping into the indentations 40'-40'''. The invention thus facilitates the connection of the dome 10 and the receiver assembly 20 because the acoustic or haptic feedback signal indicates the engagement of the at least one projection 42'-42''' with the at least one indentation 40'-40'''. Therefore, the user can easily ensure that the dome 10 by its core 12 is securely screwed onto the receiver assembly 20 by its sound outlet port 26.

The invention claimed is:

1. A dome for use with a receiver assembly, the dome comprising:

a core and a shell, wherein the core and the shell are made of different materials, the material of the core is rigid and the material of the shell is soft, wherein the dome is connectable to the receiver assembly by means of a threaded connection, wherein a front face of the core comprises an indentation and a front face of the receiver assembly comprises a projection, and wherein the indentation and the projection are configured to be engaged to each other, and wherein the indentation and the projection are tapered and configured to provide an audible feedback signal when properly engaged.

2. The dome according to claim 1, wherein the indentation and the projection are configured to be connected to each other when the core is completely screwed onto the receiver assembly.

3. The dome according to claim 1, wherein the indentation and projection are located on the front face of the core and receiver assembly, respectively.

4. The dome according to claim 1, wherein the threaded connection comprises a female thread formed into the core such to extend substantially along the longitudinal direction thereof, wherein the female thread is connectable to a male thread protruding from the receiver assembly.

5. The dome according to claim 1, wherein the threaded connection comprises a male thread protruding from the core, wherein the male thread is connectable to a female thread formed into the receiver assembly.

6. The dome according to claim 1, wherein the core comprises a cerumen filter adapted to protect the receiver assembly against entrance of cerumen.

7. The dome according to claim 6, wherein the cerumen filter is opened to a passage formed into the shell.

8. The dome according to claim 7, wherein the passage is configured to be open to an ear canal of the user of the hearing device when inserted.

9. The dome according to claim 1, wherein the core is mounted to the shell by means of a form fit connection.

10. The dome according to claim 1, wherein the core and shell are glued together.

11. The dome according to claim 7, wherein the core and shell are manufactured by means of a 2-K manufacturing.

12. The dome according to claim 1, wherein the shell is provided with a plurality of openings arranged are a circumference.

13. The dome according to claim 12, wherein the openings configured to enable a snug fit connection of the shell inside the ear canal of the user and/or for venting.

* * * * *